United States Patent [19]

Kremer et al.

[11] Patent Number: 4,848,947

[45] Date of Patent: Jul. 18, 1989

[54] LIQUID APPLICATOR DEVICE WITH TILT VALVE

[75] Inventors: Leon V. Kremer, Crystal Lake; Ronald E. Kieras, Algonquin, both of Ill.

[73] Assignee: Pittway Corporation, Cary, Ill.

[21] Appl. No.: 105,452

[22] Filed: Oct. 5, 1987

Related U.S. Application Data

[63] Continuation of Ser. No. 741,439, Jun. 5, 1985, abandoned.

[51] Int. Cl.[4] ..... A46B 11/00

[52] U.S. Cl. ..... 401/206; 401/260; 401/264; 401/273

[58] Field of Search ..... 401/135, 206, 258, 259, 401/260, 264, 273, 206; 119/72.5

[56] References Cited

U.S. PATENT DOCUMENTS

| | | | |
|---|---|---|---|
| 307,878 | 11/1884 | Stevens | 401/206 |
| 980,678 | 1/1911 | Roche | 401/273 X |
| 1,687,647 | 10/1928 | Garvey | 401/206 |
| 2,164,895 | 7/1939 | Botts | 401/273 |
| 2,210,662 | 8/1940 | Garvey . | |
| 2,392,840 | 1/1946 | DeGroft . | |
| 2,424,323 | 7/1947 | Millholland . | |
| 2,543,409 | 6/1951 | Hempel et al. . | |
| 2,575,180 | 11/1951 | Lurz | 401/264 |
| 2,623,227 | 12/1952 | Moonert . | |
| 2,624,902 | 1/1953 | Soldner . | |
| 2,637,466 | 5/1953 | Wright . | |
| 2,896,238 | 7/1959 | Riel . | |
| 3,003,183 | 10/1961 | Rosenthal . | |
| 3,003,184 | 10/1961 | Rosenthal . | |
| 3,032,802 | 5/1962 | Kusama . | |
| 3,108,314 | 10/1963 | House . | |
| 3,113,336 | 12/1963 | Langnickel . | |
| 3,127,630 | 4/1964 | LaMura . | |
| 3,133,307 | 5/1964 | Steinberg . | |
| 3,145,412 | 8/1964 | Levy . | |
| 3,153,804 | 10/1964 | Silver | 401/260 X |
| 3,159,863 | 12/1964 | LaMura . | |
| 3,233,275 | 2/1966 | Hansen et al. . | |
| 3,263,652 | 8/1966 | Nakajima et al. | 119/72.5 |
| 3,281,887 | 11/1966 | Raffe . | |
| 3,296,649 | 1/1967 | Schwartzman . | |
| 3,340,560 | 9/1967 | Nakata . | |
| 3,463,597 | 8/1969 | Wakai . | |
| 3,468,611 | 9/1969 | Ward . | |
| 3,582,006 | 6/1971 | Thompson | 119/72.5 X |
| 3,589,824 | 6/1971 | Andrews . | |
| 3,640,631 | 2/1972 | Sotir . | |
| 3,682,559 | 8/1972 | Hirota . | |
| 3,738,760 | 6/1973 | Madeira . | |
| 3,922,100 | 11/1975 | Saito . | |
| 4,043,681 | 8/1977 | Funahashi . | |
| 4,157,874 | 6/1979 | Durand . | |
| 4,198,172 | 4/1980 | Meislik . | |
| 4,224,000 | 9/1980 | Endres . | |
| 4,281,779 | 8/1981 | Shepard . | |
| 4,380,403 | 4/1983 | Endres et al. . | |
| 4,408,921 | 10/1983 | Nagai . | |
| 4,543,005 | 9/1985 | Kuboshima . | |
| 4,569,612 | 2/1986 | Schwartzman et al. | 401/206 |

FOREIGN PATENT DOCUMENTS

| | | | |
|---|---|---|---|
| 664679 | 6/1964 | Italy | 401/206 |

*Primary Examiner*—Steven A. Bratlie
*Attorney, Agent, or Firm*—Frijouf, Rust & Pyle

[57] ABSTRACT

An improved applicator device is disclosed for applying an applicator liquid such as a chemical, a coating, a solvent or other suitable liquids to a surface. The device comprises a container for containing the applicator liquid and a tilt valve secured to the container. The tilt valve has a valve element normally biased into a closed position. The valve element inhibits the flow of the applicator liquid from the container when the valve element is in the closed position and permits the flow of the applicator liquid from the container when the valve element is tilted into an open position. A surface applicator has a proximal end for receiving the applicator liquid flowing through the tilt valve and has a distal end adapted to apply the applicator liquid to the surface. Means are provided for allowing a user to laterally move the surface applicator for enabling the proximal end of the surface applicator to tilt the valve element into the open position to permit the flow of the applicator liquid from the container to the proximal end to replenish the applicator liquid at the distal end of the surface applicator. The surface applicator may be a flexible applicator such as an applicator brush, a flexible fiber tip or the like which permits a user to disperse or paint the applicator liquid on a surface. The improved applicator device is suitable for dispensing a wide variety of liquid products including inks, dyes, paints, coatings, chemicals, insect repellants, perfumes, solvents and the like.

11 Claims, 3 Drawing Sheets

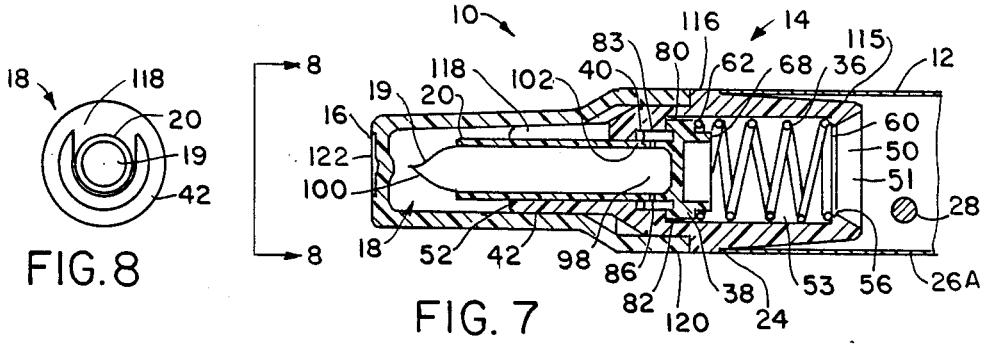
FIG. 7
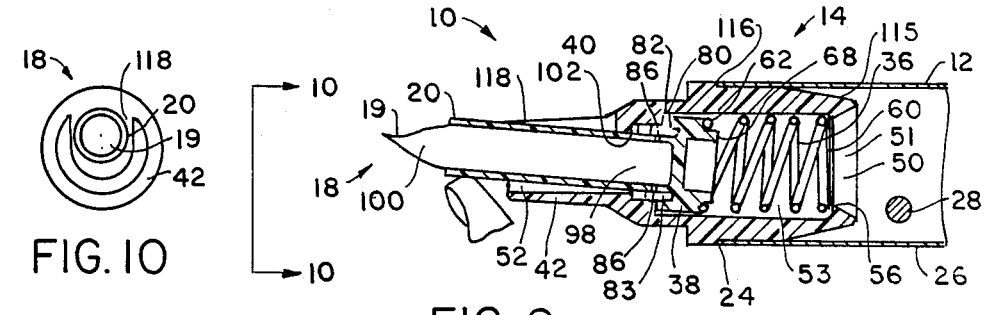
FIG. 9
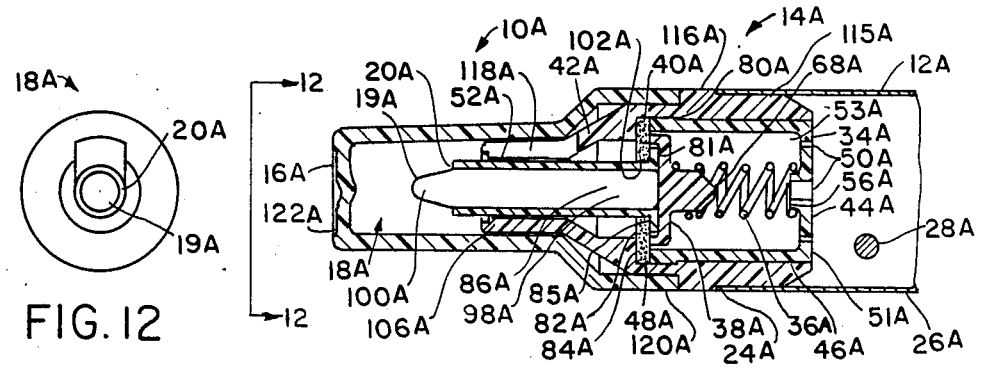
FIG. 11
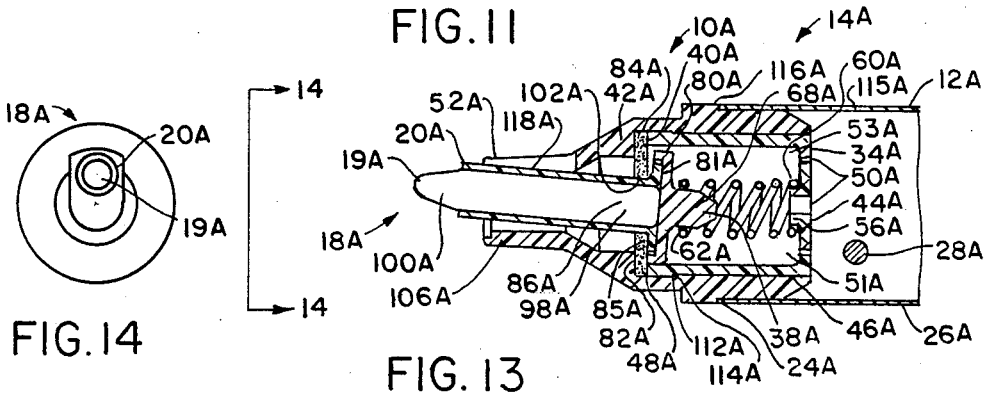
FIG. 13
FIG. 8
FIG. 10
FIG. 12
FIG. 14

LIQUID APPLICATOR DEVICE WITH TILT VALVE

This application is a continuation of application Ser. No. 741,439 filed June 5, 1985, now abandoned.

BACKGROUND OF THE INVENTION

1 Field of the Invention

This invention relates to the dispensing of liquids, and more particularly, this invention relates to an improved applicator device for applying, marking, writing or dispersing a liquid on a surface.

2 Description of the Prior Art

Various types of marking devices have been devised for marking or writing with ink, dye or paint. Among such devices are fountain pens, ball point pens, felt tip pens, capillary tube pens, fiber tip pens and the like. In addition, various other applicator devices appear in prior art for applying and/or the dispersing a wide variety of other viscous and non-viscus liquid products such as perfumes, glues, insect repellants, oils, greases, lubricants and the like. The applicator devices of the prior art have received wide acceptance due in great measure to the convenience of the devices and the ability to retain a large quantity of liquid in a liquid container. Further, the applicator devices of the prior art have received wide acceptance due to the ability to supply additional applicator liquid from a liquid container to a surface applicator at the discretion of the user.

In the past, continuing effort were made to improve the design of applicator devices, and particularly to improve the design of the mechanism in said devices which controlled the flow of the applicator liquid from the liquid container to the surface applicator. In a typical prior art applicator device, the applicator liquid flows to the surface applicator only when the applicator device is held upside down allowing the applicator liquid to flow to the surface applicator by action of gravity. Furthermore, many of the prior art marking devices which incorporated a valve mechanism were incapable of utilizing a brush as a surface applicator due to the flexibility of the brush applicator.

In addition to the problems which existed with regard to the design of the mechanism which controlled the flow of the applicator liquid in the applicator devices found in the prior art, there were other serious problems in the design, fabrication, assembly and the utilization of these applicator devices. Most prior art applicator devices incorporating a valve which required an excessively large number of parts. And, in general, prior art applicator devices incorporating a valve had to be filled with the applicator liquid and then held in an upright orientation during the process of assembling the valve mechanism. Accordingly, the unassembled component parts of the valve mechanism had to be shipped from a component parts manufacturer to a filling plant where the component parts had to be assembled concurrently with the filling of the containers. As a rule, the filling plant desires to undertake only the final assembly of a product as opposed to assembling the component parts of the valve mechanism as required by the prior art applicator devices. This not only increases the total manufacturing cost, but also requires the filling plant to provide an additional assembly line and maintain a system of quality control for the assembly of the valve mechanism. As a result of this and various other factors the unit price for liquid applicator devices has been unnecessarily high.

It should be readily appreciated that the fabrication and assembly of the valve mechanism of an applicator device independent of the liquid container is a significant advancement of the art. The applicator device of the present invention allows for the fabrication and assembly of the valve mechanism from a single manufacturing site. Thereafter, the valve mechanism may be shipped to a filling plant where the liquid containers may be filled with an applicator liquid. The valve mechanism of the applicator device may then be sealed to the filled liquid containers.

The liquid applicator devices of the prior art operated the valve mechanism upon the depression of the distal end of a rigid surface applicator. Accordingly, the liquid applicator devices of the prior art were incapable of incorporating a flexible surface applicator. In contrast, the improved applicator device of the present invention permits the use of a flexible surface applicator which may be an applicator brush, a flexible fiber tip or the like. Furthermore, the improved applicator device of the present invention provides a means for the user to actuate the valve mechanism to replenish the applicator liquid to the surface applicator independent of the depression of the distal end of the surface applicator.

It is an object of the present invention to provide an improved applicator device for dispensing an applicator liquid wherein the valve mechanism may be constructed and assembled independent of the liquid container and subsequently coupled to a filled liquid container.

Another object of the present invention is to provide an improved applicator device for dispensing an applicator liquid having an increased ease of assembly heretofor unknown in the art.

Another object of the present invention is to provide an improved applicator device for dispensing an applicator liquid which is more economical than the prior art applicator devices through the incorporation of component parts which permit the applicator device mechanism to be assembled by an assembly machine independent of the liquid container.

Another object of the present invention is to provide an improved applicator device for dispensing an applicator liquid which permits the use of a flexible surface applicator which may be an applicator brush, a flexible fiber tip or the like.

Another object of the present invention is to provide an improved applicator device for dispensing an applicator liquid incorporating a valve for sealing the liquid container of the applicator device to prevent evaporation of the liquid in the liquid container.

Another object of the present invention is to provide an improved applicator device for dispensing an applicator liquid incorporating a valve that is moveable into an open position to furnish the applicator liquid to the surface applicator upon a user laterally moving the surface applicator of the applicator device.

Another object of the present invention is to provide an improved applicator device having an improved tilt action valve interconnected to a surface applicator for permitting the flow of the applicator liquid to the applicator brush upon the lateral movement of the surface applicator.

Another object of the present invention is to provide an improved applicator device for dispensing an applicator liquid which is convenient to use for painting, marking, or applying a liquid to a surface.

The foregoing has outlined some of the more pertinent objects and advantages of the present invention. These objects and advantages should be construed to be merely illustrative of some of the more pertinent features and applications of the intended invention. Many other beneficial results can be obtained by applying the disclosed invention in a different manner or modifying the invention within the spirit and scope of the disclosure. Accordingly, other objects and advantages and a fuller understanding of the invention may be had by referring to the summary of the invention and the detailed description describing the preferred embodiments in addition to the scope of the invention defined by the claims taken in conjunction with the accompanying drawings.

SUMMARY OF THE INVENTION

The present invention is defined by the appended claims with the specific embodiments shown in the attached drawings. For the purpose of summarizing the invention, the invention may be incorporated into an improved applicator device for applying an applicator liquid to a surface, comprising a container for containing the applicator liquid therein and a valve having a valve element secured to the container. The valve element inhibits the flow of the applicator liquid from the container when the valve element is in a closed position and permits the flow of the applicator liquid from the container when the valve element is in an open position. The valve has bias means for biasing the valve element into the closed position. A surface applicator includes a distal end for applying the applicator liquid to the surface and includes a proximal end for receiving the applicator liquid. The valve element is movable from the closed position to the open position upon a lateral movement of the surface applicator to permit the flow of the applicator liquid from the container to replenish the applicator liquid at the distal end of the surface applicator.

In a more specific embodiment of the invention, the container includes a sidewall, a closed end and an open end with the valve being secured to the open end of the container. The valve may be press fitted into the open end of the container, or in the alternative the container may include container threads in the open end for threadably engaging with threads on the valve. In one embodiment of the invention, the sidewall and the closed end are substantially rigid, whereas in another embodiment of the invention, the sidewalls are flexible for reducing the internal volume of the container means to facilitate the flow of the applicator liquid from the container.

The valve element includes an annular shoulder for engaging with an annular sealing surface on the valve seal when the bias means biases the valve element into the closed position. The surface applicator is secured to the valve element whereby lateral movement of the surface applicator tilts the annular shoulder of the valve element relative to the annular sealing surface of the valve seal to move the valve element from the closed position to the open position. The valve preferably includes a valve closure with the valve seal in one embodiment being a rigid annular sealing surface defined in the valve closure and with a resilient sealing gasket being disposed between the valve closure and the surface applicator. In another embodiment of the invention, the valve seal includes a resilient sealing surface disposed between the valve closure and the valve element.

The valve closure has an internal closure cavity extending therethrough and with the valve element disposed therein. The surface applicator includes a flexible surface applicator member and a rigid applicator support with the flexible surface applicator being disposed within the rigid applicator support. The rigid applicator support of the surface applicator is located in the internal closure cavity of the valve closure for moving the valve element from the closed position to the open position upon a lateral movement of the distal end of the rigid applicator support. The valve closure preferably has a void for permitting the lateral movement of the distal end of the rigid applicator support.

In one embodiment of the invention, the flexible surface applicator is a brush applicator; whereas in another embodiment of the invention the flexible surface applicator is a fiber tip applicator. The rigid applicator support may comprise a tubular member. An optional overcap may be provided for engagement with the valve closure for covering the distal end of the surface applicator.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes for the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature, objects and advantages of the invention, reference should be made to the following detailed description taken in connection with accompanying drawings in which:

FIG. 7 is an enlarged partial sectional view of the first embodiment of the liquid applicator device of FIGS. 1–3 shown in a closed position;

FIG. 8 is a view along line 8—8 of FIG. 7 with the overcap being removed;

FIG. 9 is an enlarged partial sectional view of the liquid applicator device of FIGS. 1–3 shown in an open position;

FIG. 10 is a view along line 10—10 of FIG. 9;

FIG. 11 is an enlarged partial sectional view of the second embodiment of the liquid applicator device of FIGS. 4–6 shown in a closed position;

FIG. 12 is a view along line 12—12 of FIG. 11 with the overcap being removed;

FIG. 13 is an enlarged partial sectional view of the liquid applicator device of FIG. 4–6 shown in an open position;

FIG. 14 is view along line 14—14 of FIG. 13;

Similar reference characters refer to similar structural elements throughout the various Figures of the drawings. In addition, similar structural elements between the various embodiments of the invention are referred to with similar reference numeral followed by alphabet letter.

DESCRIPTION OF THE INVENTION

Figure 1:
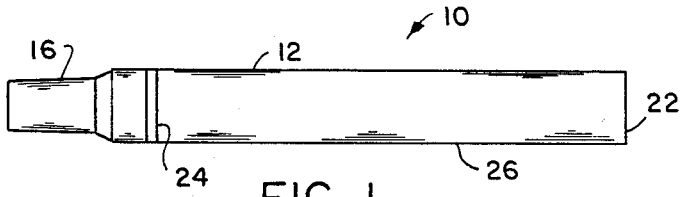
FIG. 1 is a side elevational view of a first embodiment of a liquid applicator device of the present invention in a storage condition.
Figure 2:
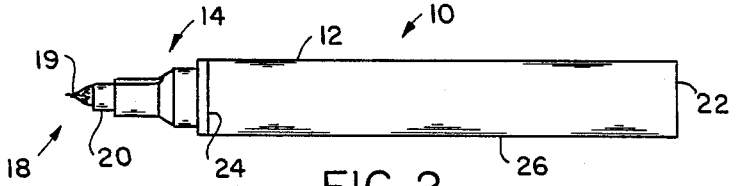
FIG. 2 is a side elevational view of the liquid applicator device of FIG. 1 in a marking condition.
Figure 3:
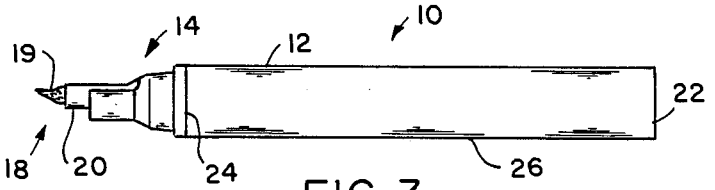
FIG. 3 is a side elevational view of the liquid applicator device of FIG. 1 in a replenishing condition wherein applicator liquid is furnished to a surface applicator.

FIGS. 1–3 are elevational views of a first embodiment of the present invention illustrating a liquid applicator device 10 comprising a liquid container 12, an applicator mechanism 14 and an overcap 16. The applicator mechanism 14 includes a surface applicator 18 including an applicator brush 19 for applying an applicator liquid to a surface (now shown) and an applicator support 20. The applicator mechanism 14 includes an internal valve, for regulating the flow of the applicator liquid from the liquid container 12 to the applicator brush 19. The valve which will be explained in greater detail hereinafter, includes a valve element 38 which is biased into a closed position and movable to an open position to permit the flow of the applicator liquid from the liquid container 12 to the applicator brush 19.

FIG. 1 illustrates the liquid applicator device 10 in a storage condition wherein the overcap 16 is affixed to the applicator mechanism 14 to cover and protect the applicator brush 19. FIG. 2 shows the liquid applicator device 10 of FIG. 1 in the marking condition wherein the overcap 16 has been removed from the applicator mechanism 14. The applicator brush 19 is exposed enabling a user to apply the applicator liquid to the surface. FIG. 3 illustrates the applicator device 10 in a replenishing condition wherein the surface applicator 18 is laterally displaced by means such as a finger of an operator or a surface (not shown) to move the valve element 38 to the open position for permitting the flow of the applicator liquid from the liquid container 12 to the applicator brush 19. The user may replenish the applicator liquid to the applicator brush 19 prior to commencing the marking task as well as intermittently replenishing the applicator liquid to the applicator brush 19 during the marking process.

Figure 4:
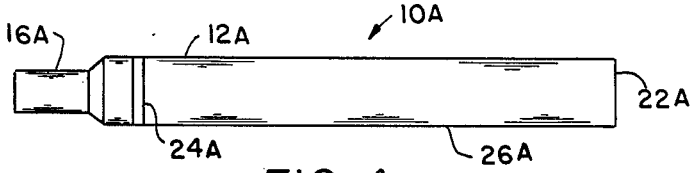
FIG. 4 is a side elevational view of a second embodiment of a liquid applicator device of the present invention in a storage condition.
Figure 5:
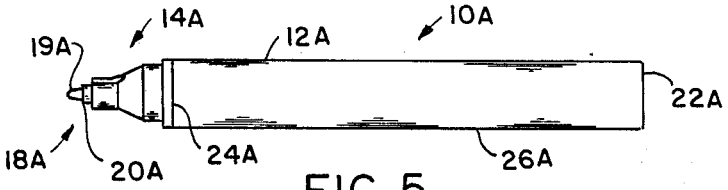
FIG. 5 is a side elevational view of the liquid applicator device of FIG. 4 in a marking condition.
Figure 6:
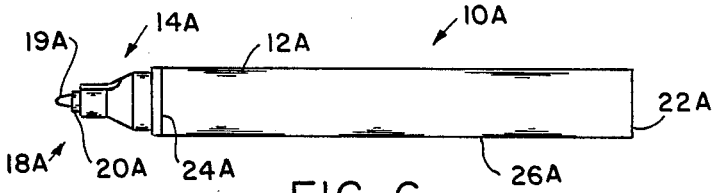
FIG. 6 is a side elevational view of the liquid applicator device of FIG. 4 in a replenishing condition wherein applicator liquid is furnished to a surface applicator.

FIGS. 4–6 are elevational views of a second embodiment of the present invention illustrating a liquid applicator device 10A comprising a liquid container 12A, an applicator mechanism 14A and an overcap 16A. The applicator mechanism 14A includes a surface applicator 18A comprising a fiber tip 19A and an applicator support 20A. The applicator mechanism 14A also includes an internal valve for regulating the flow of the applicator liquid from the liquid container 12A to the fiber tip 19A.

FIG. 4 illustrates the liquid applicator device 10A in a storage condition wherein the overcap 16A is affixed to the applicator mechanism 14A whereas FIG. 5 shows the liquid applicator device 10A in a replenishing condition wherein the surface applicator 18A has been laterally displaced to move the valve element into the open position for permitting the flow of the applicator liquid from the liquid container 12A to the fiber tip 19A.

FIGS. 7–10 illustrates in greater detail the first embodiment of the applicator device 10 shown in FIGS. 1–3. The liquid container 12 is preferably constructed of a metallic or plastic substance and is provided with a closed end 22, an open end 24 and cylindrical side walls 26. The open end 24 is adapted to receive and store a quantity of applicator liquid. When the applicator liquid is formed of opaque particles suspended in a carrier liquid, the applicator device 10 preferably includes agitator means 28 as shown as a single ball, but a plurality of balls or a metal slug may be disposed within the liquid container 12. Preferably, the agitator means 28 is formed of a metallic substance having a specific gravity significantly greater than the carrier liquid and with the metallic material being selected to minimize any chemical reaction with the carrier liquid. The agitator means 28 disburses the suspended opaque particles within the carrier liquid in the event that the suspended opaque particles have become precipitated or settled from the carrier liquid.

The applicator mechanism 14 includes bias means shown as a spring 36, a valve element 38, a valve seal 40 and a valve closure 42. The valve element 38 and the valve closure 42 are preferably formed of a plastic material or complementary materials. The valve seal 40 is formed of a resilient material such as rubber or the like. The bias means is shown in this embodiment as a compression spring 36 which is preferably formed of stainless steel or another suitable material to preclude or minimize chemical reaction with the applicator liquid. Although the bias means has been shown as a compression spring 36 in the drawings, it should be understood that various other bias means may be used such as an integral plastic spring as disclosed in U.S. Pat No. 4,471,893.

The valve closure 42 includes an opening 50 defined in a first end 51 of the valve closure 42. A second end 52 of the valve closure 42 communicates with the first end 51 through an internal cavity 53. The spring 36 is disposed adjacent the opening 50 to permit the flow of the applicator liquid into an internal cavity 53 of the valve closure 42. An annular project 56 in the valve closure 42 is integrally formed to receive and positively retain an inner end 60 of the spring 36 with an outer end 62 of spring 36 being received by a projection 68 of the valve element 38.

The valve element 38 is shown in this embodiment as integrally formed with the applicator support 20 and includes an annular shoulder 80. The spring 36 biases the annular shoulder 80 of the valve element 38 into sealing engagement with an annular sealing surface 82 located in the valve closure 42 as shown in FIG. 7. In addition, a reservoir 83 is defined by the annular shoulder 80 and the valve seal 40 when the valve element 38 is located in the closed position. The reservoir 83 retains a limited amount of the applicator liquid to flow through a plurality of apertures 86 disposed in the proximal end 98 of the surface applicator 18.

In this embodiment, the applicator support 20 is shown as a tubular member integrally formed with the valve element 38. The plurality of apertures 86 in the applicator support 20 communicate with the applicator brush 19 located internal the tubular applicator support 20. The applicator liquid entering apertures 86 moves by the force of gravity and/or by capillary action to replenish the applicator liquid dispensed by the distal end 100 of the surface applicator 18. The applicator brush 19 is formed from a plurality of separate fibers with the fibers being retained within the applicator support 20 through a friction fit, a compression fit or any other suitable means.

The valve seal 40 is formed in the shape of a disk having a central aperture 102 for receiving the applicator support 20 therein. The valve seal 40 extends between the applicator support 20 and the valve closure 42 to prevent the flow of the applicator liquid along the outer surface of the applicator support 20.

The valve closure 42 is joined to the container 12 in this embodiment by a press fit engagement. The exterior diameter 115 of the valve closure 42 is tapered to be inserted into the open end 24 of the container 12. The exterior surface of the valve closure 42 is also provided with a shoulder 116 for engaging with the open end 24 of the container 12 to axially limit the movement of the valve closure 42 relative to the container 12. The valve closure 42 is also provided with a void 118 also shown in FIGS. 8 and 10 for enabling an operator to laterally move the surface applicator 18 as shown in FIGS. 9 and 10.

The overcap 16 includes an inner end 120 having a diameter selected for a friction fit with the valve closure 42. The shoulder 116 of the valve closure 42 limits the movement of the overcap 16 on the valve closure 42. The overcap 16 has a closed outer end 122 positioned to avoid contact with the applicator brush 19 when the overcap 16 is positioned on the valve closure 42 as shown in FIG. 7. The valve closure 42 and the overcap 16 are preferably formed of acetal or a similar moldable material which will inhibit evaporation of any carrier liquid or solvent within the applicator liquid.

FIGS. 2, 7 and 8 illustrate the valve element 38 in the closed position whereas FIGS. 3, 9 and 10 illustrate the valve element 38 in the open position. When the valve element 38 is in the closed position, the liquid applicator device 10 may readily be used in a manner similar to conventional writing devices. When a user determines that the supply of applicator liquid on the distal end 100 of the surface applicator 18 has become insufficient, the user can supply additional applicator liquid to the surface applicator 18. The additional applicator liquid is supplied to the surface applicator 18 by holding the applicator device 10 with a surface applicator 18 below the container 12 and simultaneously laterally displacing the surface applicator 18 as shown in FIGS. 9 and 10. Void 118 in the valve closure 42 permits the lateral displacement of the surface applicator 18.

A lateral displacement of the surface applicator 18 causes compression of the spring 36 and the separation of the annular shoulder 80 of the valve element 38 from the annular sealing surface 82 of the valve closure 42 as shown in FIG. 9. The separation of the annular shoulder 80 from the annular sealing surface 82 permits the flow of the applicator liquid by action of gravity from the container 12 through the internal cavity 53 into apertures 86 to the proximal end 98 of the applicator brush 19. The applicator liquid may then flow by the action of gravity and/or capillary action to the distal end 100 of the applicator brush 19. The valve seal 40 insures that the flowing applicator liquid is directed through apertures 86 into the interior of the applicator support 20. A release of the lateral pressure from the surface applicator 18 will return the annular shoulder 80 of the valve element 38 into sealing engagement with the annular sealing surface 82 of the valve closure 42 as shown in FIG. 7 to inhibit the further flow of the applicator liquid from the container 12 to the surface applicator 18.

FIGS. 11–14 illustrates in greater detail the second embodiment of the applicator device 10A shown in FIGS. 4–6. The liquid container 12A is similarly constructed of a non-permeable metallic or plastic substance and is provided with a closed end 22A, an open end 24A, cylindrical side walls 26A and agitator means 28A. The applicator mechanism 14A includes a valve body 34A, bias means shown as a spring 36A, a valve element 38A, a valve seal 40A and a valve closure 42A. The valve body 34A, the valve element 38A and the valve closure 42A are preferably formed of a plastic material; whereas the valve seal 40A is formed of a resilient material.

The valve body 34A is generally cup-shaped having a bottom face 44A and cylindrical side walls 46A terminating in an annular end 48A. The bottom face 44A of the valve body 34A is provided with aperture means shown in the embodiment as a plurality of liquid passing apertures including an axial hold 50A and a plurality of radial holes. A projection 56A extends from the bottom face 44A of the valve body 34A. The projection 56A surrounds the axial hold 50A and frictionally engages an inner end 60A of the coil spring 36A. An outer end 62A of the coil spring 36A is adapted to frictionally engage a projection 68A extending from the valve element 38A.

The valve element 38A has an annular shoulder 80A disposed about a central planar region 81A. Spring 36A urges the valve element 38A into a closed position as also shown in FIG. 11 whereat the annular shoulder 80A of the valve element 38A is in contact with an annular sealing seat 82A defined by the valve seal 40A to inhibit the flow of applicator liquid therethrough. The valve element 38A may be tilted to an open position as shown in FIG. 13 whereat the annular shoulder 80A of the valve element 38A is displaced from the annular sealing surface 82A of the valve seal 40A to permit the flow of the applicator liquid from the liquid container 12A to the surface applicator 18A.

In this embodiment, the applicator support 20A is shown as a tubular member having a flat base 85A at the proximal end 98A of the surface applicator 18A. An aperture 86A in the applicator support 20A communicates with the fiber tip 19A located internal the tubular applicator support 20A. The applicator liquid entering apertures 86A moved by the force of gravity and/or by capillary action to replenish the applicator liquid dispensed by the distal end 100A of the surface applicator 18A. The fiber tip 19A is formed from a plurality of aligned fibers with the fibers being retained within the applicator support 20A through a friction fit or any other suitable means. The valve closure 42A is provided with entering ribs 106A for supporting the surface applicator 18A.

The valve seal 40A is formed in the shape of a disk having a central aperture 102A for receiving the applicator support 20A therein. The valve seal 40A extends between the applicator support 20A and the valve closure 42A to provide the resilient sealing surface 82A as well as to prevent the flow of the applicator liquid along the outer surface of the applicator support 20A. The valve seal 40A is retained between the annular end 48A of the valve body 34A and an annular shoulder 84A of the valve closure 42A when the valve body 34A is interlocked to the valve closure 42A. In this embodiment, the valve body 34A is interlocked to the valve closure 42A upon a recess 112A of the valve body 34A receiving an annular projection 114A of the valve closure 42A in a snap locking engagement.

The valve closure 42A is joined to the container 12A upon an exterior diameter 115A of the valve closure 42A being press fitted into the open end 24A of the container 12A with a shoulder 116A engaging the the open end 24A of the container 12A. The valve closure 42A is similarly provided with a void 118A for enabling an operator to laterally move the surface applicator 18A as shown in FIGS. 13 and 14.

The overcap 16A includes an inner end 120A for a friction fit with the valve closure 42A with the shoulder 116A limiting the movement of the overcap 16A on the valve closure 42A. A closed outer end 122A is positioned to avoid contact with the fiber tip 19A when the overcap 16A is positioned on the valve closure 42A as shown in FIG. 11.

FIGS. 5, 11 and 12 illustrate the valve element 38A in the closed position whereas FIGS. 6, 13 and 14 illustrate the valve element 38A in the open position. A lateral displacement of the surface applicator 18A separates the annular shoulder 80A from the annular sealing surface 82A as shown in FIG. 13 to permit the flow of the applicator liquid by action of gravity from the container 12A through the internal cavity 53A into aperture 86A of the proximal end 98A of the fiber tip 19A. The applicator liquid may then flow by the action of gravity and/or capillary action to the distal end 100 of the fiber tip 19A. A release of the lateral pressure from the surface applicator 18A will return the annular shoulder 80A into sealing engagement with the annular sealing surface 82A as shown in FIG. 11 to inhibit the flow of the applicator liquid from the container 12A to the surface applicator 18A.

Figure 15:
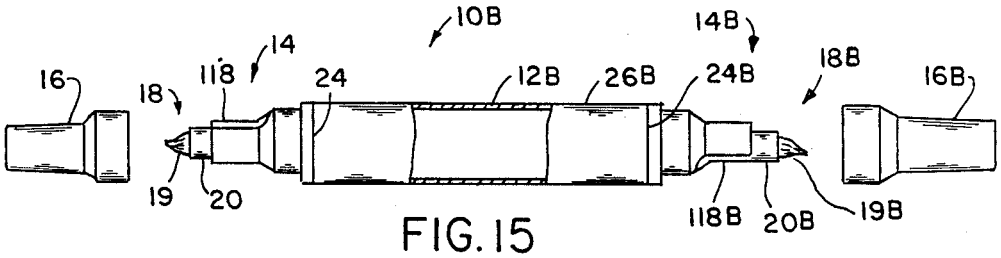
FIG. 15 is a side elevational view partially in section of a third embodiment of the present invention.

FIG. 15 is a side elevational view partially in section of a third embodiment of the present invention illustrating an applicator device 10B having a first surface applicator 18 on a first open end 24 of a liquid container 12B and a second surface applicator 18B on a second open end 24B of the liquid container 12B. In this embodiment, the first applicator mechanism 14 and the first surface applicator 18 are identical to the first embodiment 10 shown in FIGS. 1–3. The second applicator mechanism 14B and the second surface applicator 18B are shown as also being identical to the applicator mechanism 14 and the surface applicator 18 as shown in the first embodiment 10 as shown in FIGS. 1–3. In this embodiment, the liquid container 12B incorporates a common applicator liquid for dispensing through each of the first and second surface applicators 18 and 18B.

Figure 16:
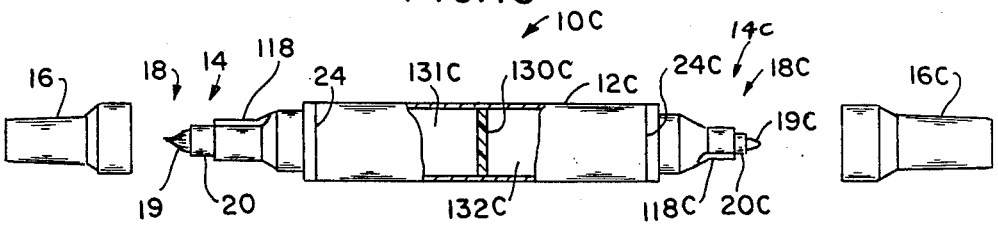
FIG. 16 is a side elevational view partially in section of a fourth embodiment of the present invention.

FIG. 16 is a side elevational view partially in section of a fourth embodiment of the present invention illustrating an applicator device 10C having a first surface applicator 18 on the first open end 24 of a liquid container 12C and a second surface applicator 18C on a second open end 24C of the liquid container 12C. In this embodiment, the first applicator mechanism 14 is identical to the first applicator mechanism in embodiment 10 shown in FIGS. 1–3, whereas the second applicator mechanism 14C is identical to the second applicator mechanism in embodiment 10A shown in FIGS. 4–6. In this embodiment, the liquid container 12C contains an intermediate wall 130C to separate the liquid container 12C into a first and a second container portion 131C and 132C to respectively receive a first and a second applicator liquids for dispensing through the first and second surface applicators 18 and 19C, respectively. The intermediate wall 130C may be inserted into a tubular container such as the container 12B or may be integrally formed with the container 12C.

Figure 17:
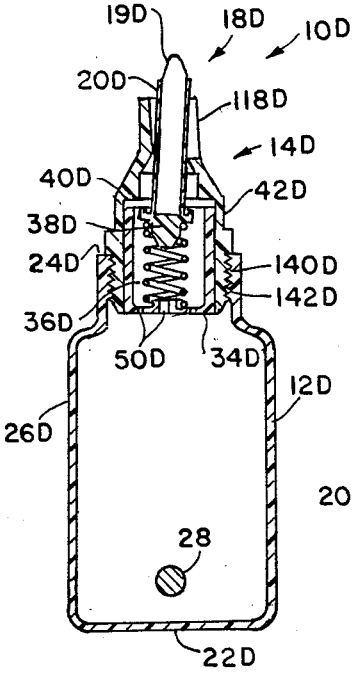
FIG. 17 is a side sectional view of a fifth embodiment of the present invention incorporating a flexible wall container.

FIG. 17 is a sectional view of a fifth embodiment of the present invention illustrating a liquid applicator device 10D comprising a liquid container 12D, an applicator mechanism 14D and an overcap (not shown). The applicator mechanism 14D includes a surface applicator 18D. The applicator mechanism 14D is identical to the applicator mechanism 14A shown in FIGS. 11–14 except as noted herein. In this embodiment, the valve closures 42D comprises threads 140D for engaging with threads 142D on the liquid container 12D. The use of a threaded engagement between the valve closure 42D and the container 12D enables the user to refill the liquid container 12D with the applicator liquid. When the applicator liquid in the liquid container 12D has been depleted, the applicator mechanism 14D may be unscrewed and separated from the liquid container 12D and refilled with applicator liquid. The applicator mechanism 14D may be then replaced on the liquid container 12D for further use. During the refilling process, the components of the applicator mechanism 14D remain in an interlocked combination in contrast to the prior art devices. It should be appreciated by those skilled in the art that various other means may be incorporated for securing the applicator mechanism 14D to the liquid container 12D.

The applicator device 10D also includes a flexible wall container 12D which is preferably a flexible plastic container enabling the user to reduce the internal volume of the container 12D by squeezing or otherwise flexing the container sidewall 26D. The applicator mechanism 14D in combination with the flexible wall container 12D allows the user to dispense the applicator liquid under pressure. The dispensing of the applicator liquid under pressure enables the dispensing of larger volumes of liquid or more viscous liquids. Although the means of dispensing the applicator liquid under pressure has been shown as a flexible wall liquid container 12D, it should be understood that various other means may be used to reduce the internal volume of the liquid container.

Figure 18:
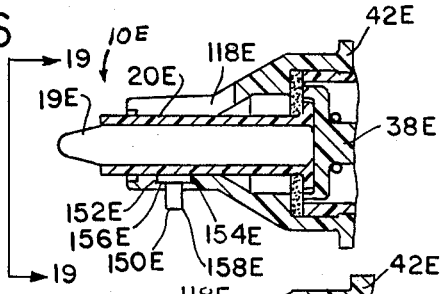
FIG. 18 is a side sectional view of a sixth embodiment of the liquid applicator device shown in a closed position.
Figure 20:
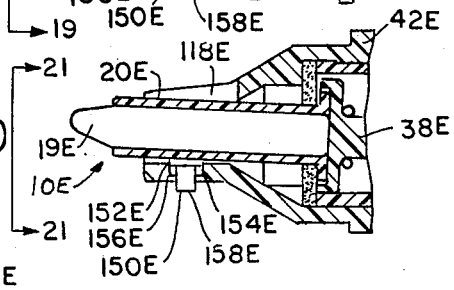
FIG. 20 is a side sectional view of the sixth embodiment of the liquid applicator device shown in an open position.
Figure 19:
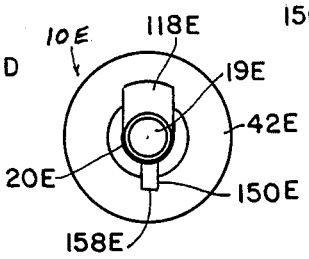
FIG. 19 is a view along line 19—19 of FIG. 18.
Figure 21:
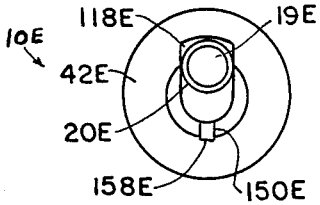
FIG. 21 is a view along line 21—21 of FIG. 20.

FIGS. 18–21 illustrate a sixth embodiment of the invention shown as a liquid applicator device 10E which is identical to the applicator device 10A of FIGS. 11–14 except as noted herein. In this embodiment, a button 150E having an enlarged base 152E is received within an aperture 154E in the valve closure 42E. The aperture 154E includes a recess 156E for receiving the enlarged base 152E of the button 150E to retain the button 150E in the valve closing 42E. FIGS. 18 and 19 illustrate the applicator device 10E in the marking condition whereas FIGS. 20 and 21 illustrate the applicator device 10E in the replenishing condition. The button 150E provides a convenient means for laterally displacing the surface applicator 19E by depressing an outer end 158E of the button 150E with the index finger of the user or another appropriate surface.

The liquid applicator device of the present invention may readily be used in a manner similar to conventional writing devices or may readily be used to apply other liquids such as perfumes, chemicals, lubricants or most any other desired liquid. With the removal of the overcap 16 the surface applicator is exposed for applying the applicator liquid on a desired surface in a conventional manner. When a user determines that the supply of applicator liquid on the surface applicator is insufficient, the user can supply additional applicator liquid by holding the surface applicator below the container and laterally displacing the surface applicator as heretofore described. With the fifth embodiment 10D incorporating the flexible container 12D as shown in FIG. 17, the surface applicator 18D need not be located below the container 12D since the flow of the applicator liquid is effected by the pressure applied to the flexible sidewall 26D. The use of a flexible sidewall 26D enables the user to replenish applicator liquid to the surface applicator 18D in any position. The lateral displacement of the surface applicator may be effected by applying lateral pressure against a surface (not shown) or a finger as shown in FIG. 9, or through the depression of the actuator button as shown in FIG. 20 or any equivalent means.

The applicator device of the present invention may be fabricated entirely by automated machinery. The component parts of the applicator mechanism may be joined together into a snap locking engagement by an automatic multistage machine process. The completed applicator mechanism may be shipped to a filling plant wherein the applicator liquid is placed within the liquid container. The applicator mechanism is then secured to the liquid container by the filling plant.

The present disclosure includes that contained in the appended claims as well as that of the foregoing description. Although this invention has been described in its preferred forms or embodiments and methods with a certain degree of particularity, it is understood that the present disclosure of the preferred form has been made only by way of example and that numerous changes in the details of construction, fabrication and use, and including the combination and arrangement of parts and steps, may be resorted to without departing from the spirit and scope of the invention.

What is claimed is:

1. An improved applicator device for applying the applicator liquid to a surface comprising:

a container having an open end for containing the applicator liquid therein;

a valve body having a closed end and an open end defining an internal body cavity therein;

aperture means disposed proximate said closed end of said valve body for permitting the applicator liquid to flow from said container into said internal body cavity of said valve body;

a valve closure having a closing aperture and an internal closure cavity;

said internal closure cavity of said valve closure defining an internal closure shoulder having an outer shoulder portion and an inner shoulder portion;

a planar sealing gasket having an annular gasket surface surrounding a central applicator aperture;

said annular gasket surface of said planar sealing gasket having an outer gasket surface and an inner gasket surface;

means for securing said valve body to said valve closure with said outer gasket surface of said planar sealing gasket being retained between said open end of said valve body and said outer shoulder portion of said valve closure;

means for securing said valve body and said valve closure to said container;

a valve element disposed within said internal body cavity of said valve body;

bias means coacting between said closed end of said valve body and said valve element for biasing said valve element into sealing engagement with said planar sealing gasket to define a closed position;

said valve element having a central mounting region and an annular valve sealing surface;

said annular valve sealing surface extending from the periphery of said valve element generally perpendicular to said planar sealing gasket thereby defining a projecting annular valve sealing surface;

only said projecting annular valve sealing surface of said valve element engaging said inner gasket surface of said planar sealing gasket when said valve element is biased into said closed position;

a surface applicator having a distal end for applying the applicator liquid to the surface and having a proximal end for receiving the applicator liquid;

said surface applicator comprising an inner flexible surface applicator member disposed within an outer rigid applicator support;

said surface applicator extending through said closure aperture of said valve closure and said central applicator aperture of said sealing gasket with said proximal end of said surface applicator operatively secured to said central mounting region of said valve element;

said valve element inhibiting the flow of the applicator liquid from said container when said valve element is in said closed position and for permitting the flow of the applicator liquid from said container when said valve element is in an open position;

said valve element being movable from said closed position to said open position upon a lateral movement of said distal end of said outer rigid applicator support to separate at least a portion of said annular valve sealing surface of said valve element from said inner gasket surface of said planar sealing gasket to permit the flow of the applicator liquid from said container to replenish the applicator liquid to said distal end of said surface applicator.

2. An improved liquid applicator device as set forth in claim 1, wherein said means for securing said valve body and valve closure to said container includes said valve body and valve closure being press fitted into said open end of the container.

3. An improved liquid applicator device as set forth in claim 1, wherein said means for securing said valve body and valve closure to said container includes said container having container threads in said open end and said one of said valve body and valve closure having threads for threadably engaging said container threads.

4. An improved liquid applicator device as set forth in claim 1, wherein said container includes a sidewall, a closed end and an open end; and said sidewall and said closed end being substantially rigid.

5. An improved liquid applicator device as set forth in claim 1, wherein said container includes a sidewall, a closed end and an open end; and said sidewall being flexible for reducing the internal volume of said container to facilitate the flow of the applicator liquid from said container.

6. An improved liquid applicator device as set forth in claim 1, wherein said means connecting said valve body to said valve closure includes a recess disposed in one of said valve body and said valve closure for receiving a projection extending from the other of said valve body and said valve closure.

7. An improved liquid applicator device as set forth in claim 1, wherein said valve closure includes a void for permitting said lateral movement of said rigid applicator support.

8. An improved liquid applicator device as set forth in claim 1, wherein said flexible surface applicator is a brush applicator.

9. An improved liquid applicator device as set forth in claim 1, wherein said flexible surface applicator is a fiber tip applicator.

10. An improved liquid applicator device as set forth in claim 1, wherein said rigid applicator support includes a tubular member.

11. An improved liquid applicator device as set forth in claim 1, including an overcap engagable with said valve closure for covering said distal end of said surface applicator.

* * * * *

UNITED STATES PATENT AND TRADEMARK OFFICE

CERTIFICATE OF CORRECTION

PATENT NO. : 4,848,947

DATED : July 18, 1989

INVENTOR(S) : Kremer et al.

It is certified that error appears in the above-identified patent and that said Letters Patent is hereby corrected as shown below:

Column 1, line 20, after "and/or" delete "the".

Column 1, line 21, delete "non-viscus" and insert therefore --non-viscous--.

Column 1, line 32, delete "effort" and insert therefore --efforts--.

Column 1, line 51, delete "which" and insert therefore --have--.

Column 2, line 6, delete "of" (first occurrence) and insert therefore --in--.

Column 2, line 50, insert missing lines as follows: --Another object of the present invention is to provide an improved applicator device for dispensing a wide variety of liquid products such as inks, dyes, paints, chemicals, insect repellants, perfumes, solvents, coatings and the like.--

Column 5, line 43, delete "now" and insert --not--.

Column 6, line 16, after "10A" insert --in a marking condition. Fig. 6 illustrates the applicator device 10A--.

Column 6, line 62, delete "project" and insert --projection--.

UNITED STATES PATENT AND TRADEMARK OFFICE

CERTIFICATE OF CORRECTION

PATENT NO. : 4,848,947

DATED : July 18, 1989

INVENTOR(S) : Kremer et al.

It is certified that error appears in the above-identified patent and that said Letters Patent is hereby corrected as shown below:

Column 9, line 6, delete "entering" and insert therefore --centering--.

Signed and Sealed this

Twenty-fourth Day of July, 1990

*Attest:*

HARRY F. MANBECK, JR.

*Attesting Officer*

*Commissioner of Patents and Trademarks*